US005107939A

United States Patent [19]

Lenhart et al.

[11] Patent Number: 5,107,939

[45] Date of Patent: Apr. 28, 1992

[54] ELECTRICALLY CONDUCTING AN ORIENTATION SIGNAL IN A DIRECTIONALLY DRILLED WELL

[75] Inventors: Robert A. Lenhart, Cypress; Allen K. Rives, Houston, both of Tex.

[73] Assignee: Ensco Technology Company, Houston, Tex.

[21] Appl. No.: 665,877

[22] Filed: Mar. 7, 1991

Related U.S. Application Data

[63] Continuation-in-part of Ser. No. 586,467, Sep. 21, 1990.

[51] Int. Cl.[5] ..... E21B 7/00

[52] U.S. Cl. ..... 175/61; 175/40

[58] Field of Search ..... 175/61, 75, 40, 45, 175/57, 320; 166/65.1, 66, 77

[56] References Cited

U.S. PATENT DOCUMENTS 3,107,729 10/1963 Barry et al. ..... 175/40

3,825,079 7/1974 Heilhecker ..... 175/40 X 4,196,781 4/1980 Cheek ..... 175/61

4,365,676 12/1982 Boyadjieff et al. ..... 175/61

*Primary Examiner*—Thuy M. Bui

*Attorney, Agent, or Firm*—Fulbright & Jaworski

[57] ABSTRACT

A method and apparatus for drilling a directional well by running and setting a retrievable steering tool in the drill pipe with a wireline conductor and removable supporting the upper end of the conductor from a fluid passing support seated on the shoulder inside the drill string. Telescopically inserting a single piece conductor wire into the drill pipe from the outside through a non-rotatable connection and into the drill string for raising the lowering the lower end of the single piece conductor in a telescopically and sealingly engaging connection to the wireline electrical conductor for transmitting communication from the steering tool to the well surface.

7 Claims, 3 Drawing Sheets

FIG.3
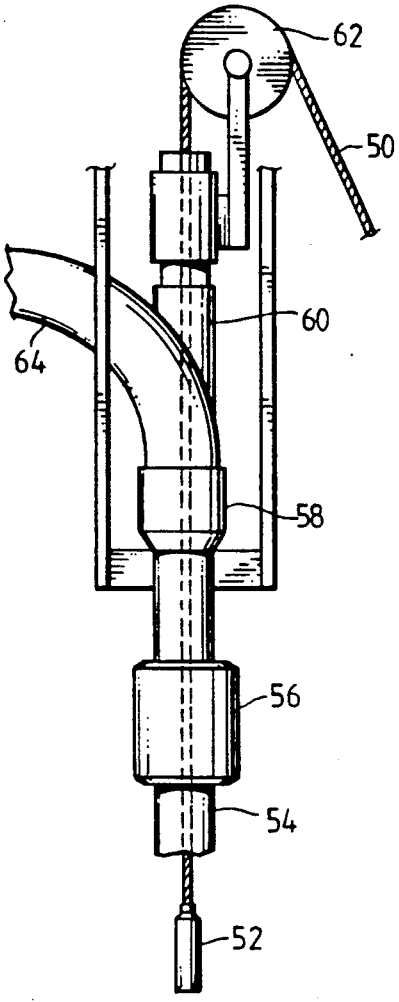
FIG.4
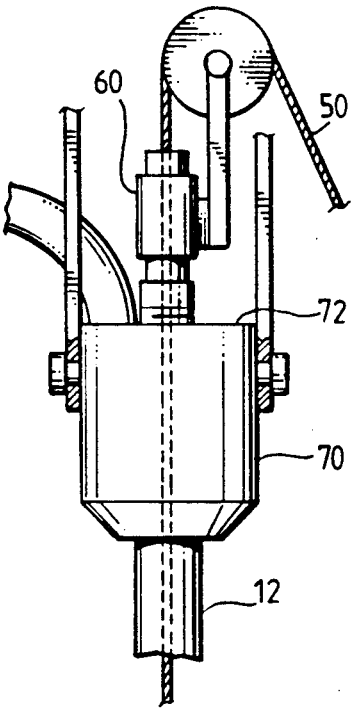
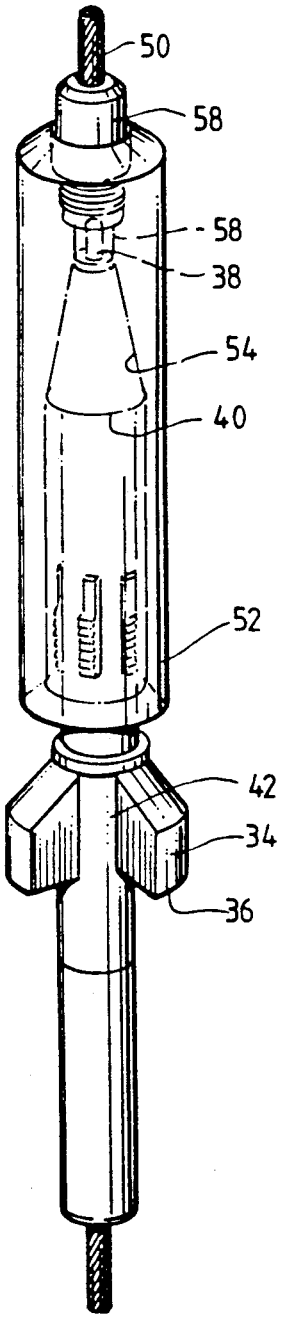
FIG.2
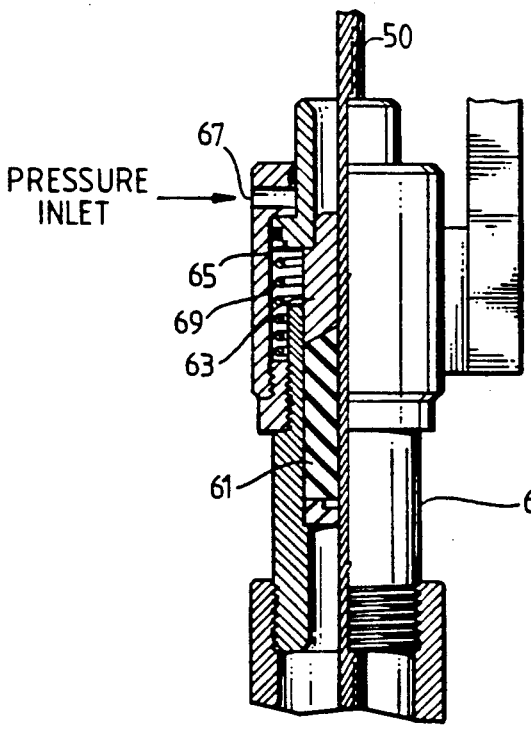
FIG.5

ELECTRICALLY CONDUCTING AN ORIENTATION SIGNAL IN A DIRECTIONALLY DRILLED WELL

CROSS-REFERENCE TO RELATED APPLICATION

This application is a continuation in part of application Ser. No. 07/586,467, filed Sep. 21, 1990, entitled "Electrically Conducting an Orientation Signal in a Directionally Drilled Well".

BACKGROUND OF THE INVENTION

Drilling directional and/or horizontal wells requires the use of a survey tool, referred to as a steering tool, to monitor the well bore path. One method of transmitting the survey information required to measure the orientation of the drill bit and well bore path is by the use of an electrical conductor connected between the steering tool and the well surface for conducting signals.

Horizontal or high angle well bores, unlike conventional vertical well bores, are used to drill long well bore intervals in the target pay zone. As a result, many horizontal wells are drilled live (producing oil/gas) which requires the use of blowout control equipment at the well surface and around the outside of the drill string. This requires that the electrical conductor conducting signals from the steering tool to the well surface be inside of the drill string.

In directional and/or horizontal drilling, steerable drilling motors or rotary drilling assemblies are used to drive a drill bit to drill a controlled well path. This technology requires a combination of drill string rotation and slide drilling to control the direction and inclination of the drill path. Conventional wireline steering techniques prevent drill string rotation while the steering tool is downhole and connected through an electrical conductor to the well surface. Pulling the electrical conductor and/or steering tool for string rotation is not always economical or achievable in high angle and horizontal drilling due to seating problems. These problems are further magnified as the wireline electrical conductor from the well surface to the steering tool must be lengthened or shortened as additional pipe joints are added to or subtracted from the drill string as drilling continues. This creates additional problems of support of the electrical conductor in deep wells.

The present invention is directed to the use of a wireline electrical conductor method and apparatus for connection to a steering tool used to monitor tool face orientation and to survey the well path in directional and/or horizontally drilled wells. The present invention allows better control of the well while drilling, especially during live drilling, as the wireline electrical conductor will be totally inside the drill string. In addition, drill string rotation for steerable drilling assemblies is not hampered by the wireline electrical conductor due to its construction and operation. Furthermore, the wireline conductor may be quickly positioned so as not to interfere with the addition to or the substraction of pipe joints to the drill string.

SUMMARY

The present invention is directed to a method of drilling a directional well with a drill bit in a drill string having a steering tool measuring the orientation of the drill bit. The method includes the improvement of connecting an electrical conductor between the steering tool and the well surface and includes drilling a well bore to a location where directional drilling is to start, running and setting a retrievable steering tool in the drill string with a wireline electrical conductor connected to the steering tool, and retrievably supporting the upper end of the wireline conductor from a fluid passing support seated on a shoulder inside the drill string. The method also includes inserting a single piece conductor wire into the drill string and releasably telescopically and sealingly connecting the lower end of the single piece conductor to the wireline electrical conductor. The upper end of the single piece conductor is connected telescopically through the drill string above the blowout preventer and to the outside of the drill string through a nonrotatable connection to the drill string for raising and lowering the lower end of the single piece conductor in the drill string and for transmitting communication with the steering tool to the well surface.

Yet a still further object of the present invention is the method including retracting the lower end of the single piece conductor wire to the top of the drill string, opening the drill string, inserting an electrical wireline segment into the drill string and releasably telescopically and sealingly connecting the lower end of the wireline segment to the wireline electrical conductor. The upper end of the wireline segment is supported in the drill string by a fluid passing support having outwardly and downwardly directed spring fingers seated on a shoulder. And the method further includes releasably, telescopically and sealingly connecting the lower end of the single piece conductor to the upper end of the wireline segment.

Yet a still further object of the present invention is the method of inserting the single piece conductor wire telescopically through a suitable packoff in a nonrotatable portion of a swivel connected to the drill string in which the single piece conductor wire has a first and second end. A telescopically electrical connector is connected on the second end inside the swivel and is adapted to releasably, telescopically and sealingly connect to the wireline electrical conductor. The first end is positioned outside of the swivel for transmitting communication with the steering tool.

The method includes, when it is desired to transmit communication with the steering tool to the well surface, disengaging the packoff from the single piece conductor, lowering the second end of the single piece conductor down the drill string, and releasably, telescopically and sealingly connecting the second end of the single piece conductor wire to the wireline electrical conductor.

Yet a further feature of the present invention is, when the distance of the upper end of the wireline conductor from the swivel reaches a predetermined distance, inserting a wireline segment into the drill string and releasably, telescopically and sealingly connecting the lower end of the wireline segment to the wireline electrical conductor. The upper end of the wireline segment is supported in the drill string by a fluid passing support having outwardly and downwardly directed spring-biased fingers on a shoulder.

Still a further object of the present invention is a system for drilling a directional well including the improvement of means for electrically transmitting signals from the steering tool to the well surface including a wireline electrical conductor connected to the steering tool and extending upwardly in the drill string, a retrievable cable support and connector connected to the upper end of the wireline electrical conductor, said support and connector including a support shoulder for supporting the conductor in a drill string, said connector including a passage therethrough for the passage of fluids through the drill string, said connector including an upstanding electrical contact, and said connector including a fishing shoulder for removal of said conductor and the steering tool from the drill string and said connector including conical sealing means positioned below the electrical contact. A landing shoulder such as a landing sub is provided in the drill string having a seating shoulder for receiving the support shoulder and supporting the conductor. A swivel having a nonrotatable portion is connected to the upper end of the drill string and the swivel portion includes an opening therethrough with a retractable sealing packoff around the opening. A single piece conductor wire is slidably movable through the opening and includes first and second ends. The second end is positioned in the drill string and includes a telescopically electrical connector adapted to be releasably, telescopically and sealingly connected to the upstanding electrical contact, and the first end is positioned outside of the swivel for transmitting communication with the steering tool to the well surface.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 2 is an enlarged perspective elevational view of the support and connector member illustrated in FIG. 1B, FIG. 3 is an enlarged, fragmentary elevational view of one type of passage of the electrical conductor through the drill string, FIG. 4 is a fragmentary, elevational view of another type of construction of illustrating the passage of the electrical conductor through the drill string, FIG. 5 is an enlarged, fragmentary, and partially cross-sectional view, illustrating a packoff for connection to the drill string for sealing around the electrical conductor.

BRIEF DESCRIPTION OF THE PREFERRED EMBODIMENTS

Figure 1E:
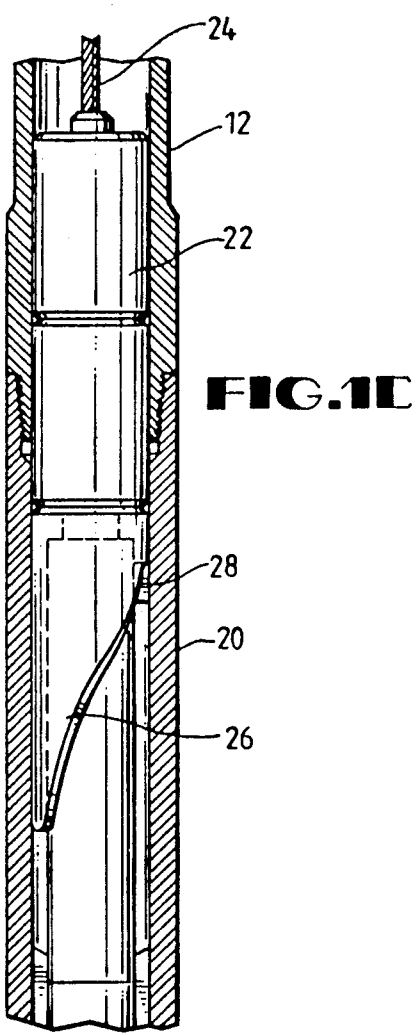
FIG. 1A is a schematic, elevational view illustrating the beginning of drilling a directional and/or horizontal well.
FIG. 1B is an enlarged, fragmentary elevational view, partly in cross section, of a portion of the drilling string of FIG. 1A.
FIG. 1C is a continuation of FIG. 1B.
Figure 1B:
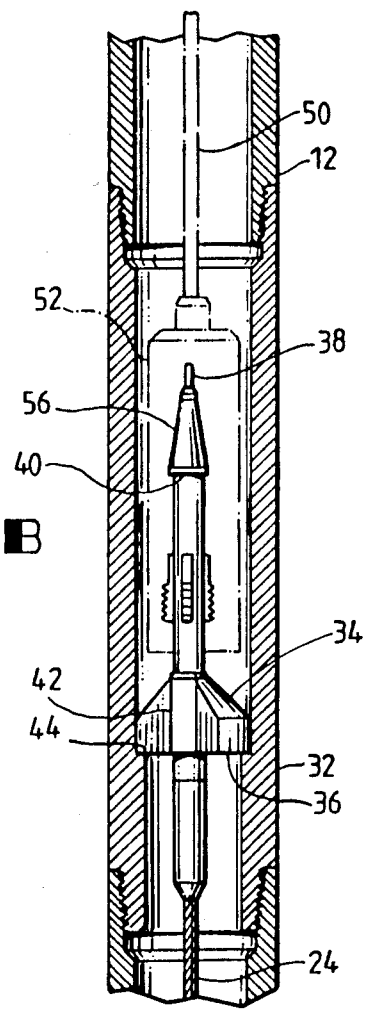
Figure 1A:
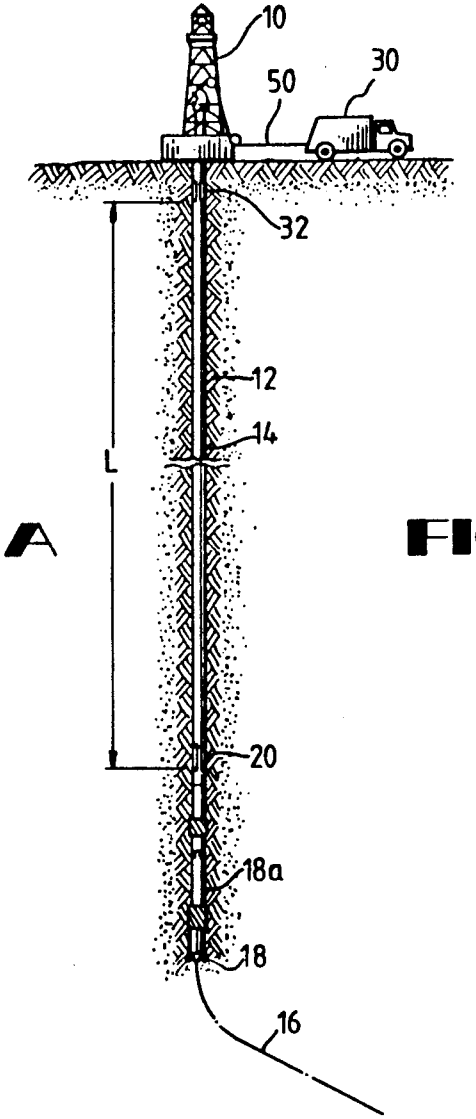

Referring now to the drawings, and particularly to FIG. 1A, a drill rig 10 is shown for operating a drill string 12 for drilling a well bore 14. As shown, the well bore 14 is generally vertical, but as indicated by the broken line 16, the further direction of the drill string 12 is nonvertical, and may be horizontal. As shown in FIG. 1A, the drilling bit 18 is just above the location where the oriented/steerable drilling is to start. In order to drill a directional path 16, a conventional downhole fluid drive motor or steerable motor **18*a* includes a drill bit 18 and is actuated by the flow of fluid down the inside of the drill string 12. The axis of the bit 18 is offset from the axis of the hole 14. The offset drill bit 18 can also be used for drilling a straight bore 14 by continuously rotating the drill string 12 until the directional correction is required. At that time, rotation of the drill string 12 is then stopped, the steerable fluid motor 18*a* is oriented in the required direction, and the drilling continues along the path 16 by fluid actuation of the motor 18*a* driving the bit 18. One suitable downhole motor is offered by Trudril. In order to drill an oriented hole, the drill string 12 includes an orienting sub 20 (FIG. 1A and 1C) which is rotatably aligned with the steerable drilling motor 18*a*. A conventional wireline steering tool 22 (FIG. 1C) such as offered by Tensor, is lowered on an electrical conductor 24 and seated in the orienting sub 20. Conventionally, a muleshoe 26 is used which is connected to tool 22 and orients the tool 22 relative to a key 28. The muleshoe 26 may be either a latching or a nonlatching type. Thus the muleshoe 26 orients the steering tool 22 relative to the steerable motor 18*a***. The above described apparatus and method is generally conventional.

The present method and apparatus is directed to the improvement in connecting the electrical conductor 24 between the steering tool 22 and a wireline measurement unit 30 located at the well surface.

A cable head landing sub 32 (FIGS. 1A and 1B) having a shoulder 44 is included in the drill string 12. The upper end of the electrical conductor 24 is connected to a cable support/connector 34 (FIG. 1B and 2). The cable support/connector 34 is designed to provide a variety of functions. First, the connector 34 includes a support shoulder 36 for seating on shoulder 44 for supporting the cable 24 which has a length L, for example, 6000 feet and also supports the steering tool 22 during running. The connector 34 provides an electrical contact 38 which is electrically connected to the cable 24 and extends upwardly for connection to a releasing, telescoping and sealing socket, as will be more fully discussed hereinafter. In addition, the support/connector 34 includes a fishing shoulder 40 above the shoulder 36 to allow the conductor 34, cable 24 and steering tool 22 to be retrieved or fished out of the drill string 12 when desired. Furthermore, the connector 34 includes one or more openings 42 to allow fluid flow down the interior of the drill string 12 and to the motor **18*a* and the bit 18. Also, the connector includes a conical sealing surface 56 for coacting with a conical sealing surface 54 on socket 52** to seal off the electrical connections from the well fluids. The sealing surfaces are preferably plastic and satisfactory materials are those sold under the trademark "ULTEM" or "NYLON".

In order to avoid interfering with the rotation of the drill string 12 or the use of blowout preventers (not shown) the cable 24 and the electrical contact 38 are connected through the interior of the drill pipe 12 and in electrical communication with the wireline unit 30.

First, a single piece conductor wire 50 is lowered into the drill string 12 and includes a socket 52 (FIG. 1B and 2) which is adapted to coact with the connector 34 and electrode 38 to provide a retrieving, telescoping, sealable, and waterproof electrical connection. The socket 52 includes a conical sealing surface 54 which coacts with a conical sealing surface 56 on the connector 34 for making a water-tight connection below the electrode 38. If desired a weight bar 58 may be used to insure that the socket 52 is securely engaged with the connector 34.

The socket 52 may, therefore, be lowered by the conductor 50 to engage and make electrical contact between the receptacle 53 and electrode 38 or may be telescopically released therefrom by raising the lower end of the conductor wire 50. The upper end of the single piece conductor wire 50 is then run upwardly through the interior of the drill pipe 12 and telescopically through a nonrotatable connection through the drill string 12 and to the wireline unit 30. The conductor wire 50 may exit the drill pipe 12 through several arrangements which will not interfere with rotation of the drill pipe 12. In FIG. 3, the conductor wire 50 is passed through the interior of a kelly joint 54 which is connected to and rotates the drill pipe 12, a swivel 56 which allows rotation of the kelly joint 54 relative to a nonrotatable connection 58, a releasable packoff 60 and around a pulley 62. Hose 64 is provided as is conventional for supplying mud to the drill pipe 12.

In the arrangement of FIG. 4, a power swivel 70 is provided connected to the drill pipe 12 for rotating the drill pipe 12 by a suitable power source (not shown) in which the swivel includes a nonrotatable housing 72 and a releasable packoff 60.

Referring now to FIG. 5, a suitable releasable packoff 60 is shown for sealably engaging against the single piece conductor wire 50 for preventing the escape of hazardous well fluids. The packoff 60 is releasable for allowing the telescopic movement of the wire 50 relative to the packoff 60 and the drill pipe 12. The packoff 60 includes a sealing member 61 which is actuated into a sealing engagement with the conductor wire 50 by wedge member 63 which in turn is actuated by piston 65. Pressure port 67 is provided for hydraulic or air pressure for actuation of the piston 65 for sealing against wire 50. A spring return 69 acts against the piston 65 to release the seal 61 upon release of the pressure at port 67. In either the well installation of FIG. 3 or 4, the single piece conductor wire 50 may be actuated to allow rotation of the drill string 12 without being hampered by the wire 50 and its socket 52.

For example, when rotary drilling of the drill string 12 is required, the packoff 60 is released, the lower end of the conductor wire 50 and the socket 52 is telescopically withdrawn and releasably disengaged from the connector 34. Drilling is commenced after engaging the packoff 60 against the conductor wire 50.

When a survey of the orientation of the drill bit 18 or well bore path is required, the packoff 60 is deactuated and the lower end of the single piece conductor wire 50 and socket 52 is lowered into position, as best seen in FIGS. 1B and 2 to provide a telescoping, sealing, and electrical connection between the receptacle 53 and the electrical contact 38. The survey is then taken. If steering is required, the drill bit 18*a* can be oriented and slide drilling can begin. If desired, when drilling with the motor 18, the electrical connection between the steering tool 22 and the wireline unit truck 30 at the well surface may be maintained by telescopically extending the wire 30 as drilling continues. Of course, if rotary drilling of the entire drill string 12 is required, the lower end of the wire 50 and its socket 52 is raised and released from the connector 34. When surveying is not required, the socket 52 and the lower end of the connector wire 50 is maintained adjacent the upper end of the drill pipe 12 against a swivel in order to allow the addition or substraction of additional pipe joints in the drill string 12.

However, after drilling has continued and additional joints of pipe have been added to the drill string 12 so that the support/connector 34 is a predetermined distance, for example, 1000 or 2000 feet from the well surface, it is desirable to utilize an intermediate wire segment 80 (FIGS. 6 and 7) in order to minimize the trip time for lowering and raising the socket 52 for taking an orientation survey. That is, after the bore hole 14 has been drilled to a depth that makes tripping the wet connector socket uneconomical, a long segment of wire 80 which includes a socket 52 on its bottom end is run into the drill string 12 and seated on the connector 34. The top end of the segment 80 includes an intermediate support connector 90 (FIG. 7) which is generally similar to the support connector 34 with the exception that the connector 90 includes a plurality of outwardly biased spring fingers 92. The advantage of using a split skirt or multiple split fingers 92 is that they will stick out providing a support shoulder to support the weight of the segment wire 80 and will catch on a groove or a ring in a support sub or tool joint. That is, the relaxed OD of the spring fingers 92 can be larger than the minimum ID of the drill pipe 12. This is an advantage over using a solid support shoulder as any such solid support shoulder would have to be larger than the diameter of the downhole support/connector 34 which in turn would therefore adversely require that the ID of the sub 32 be unduly restricted.

Figure 6:
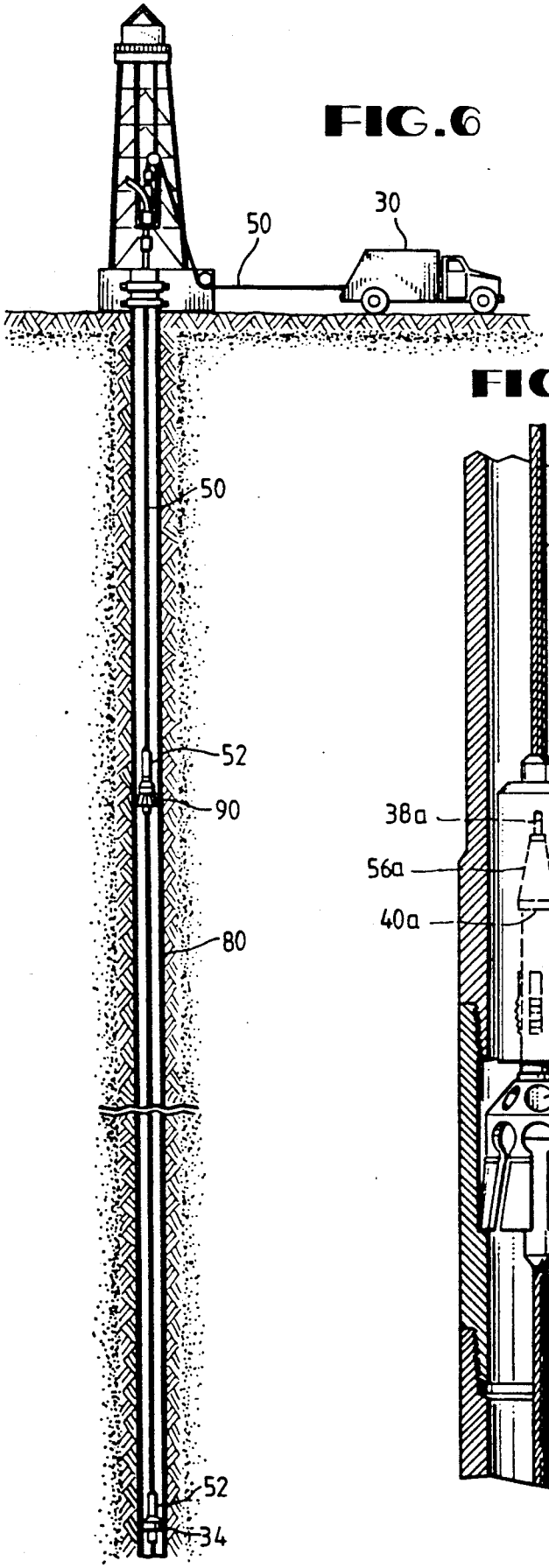
FIG. 6 is a schematic, elevational view, illustrating the use of a wireline segment when the distance of the upper end of the wireline conductor reaches a predetermined distance.
Figure 7:
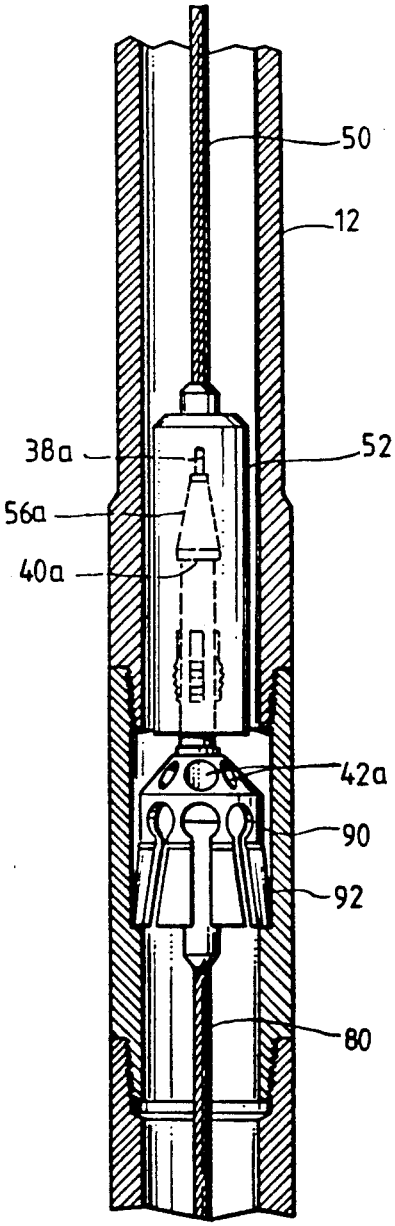
FIG. 7 is a fragmentary, elevational view, partly in cross section, illustrating another embodiment of a connector and support member.

The connector support 90 includes an upstanding electrical contact 38*a*, a tapered sealing surface 56*a*, a fishing neck 40*a*, fluid passageways 42*a*. Therefore, with the intermediate segmented cable 80 in place, the intermediate cable support connector 90 will also coact with the socket 52 of the single piece conductor wire 50, as best seen in FIGS. 6 and 7. Therefore, the installation of FIGS. 6 and 7 may be operated and worked identically to the above-described operation in connection with FIGS. 1-5.

Thus, drilling may be continued by connecting the socket 52 to the intermediate connector 90 when steer drilling or a survey is required.

In tripping out of the well bore 14, the socket 52 is pulled upwardly to the upper end of the drill pipe 12 by the conductor 50 for the trip. If used, the intermediate wire segment 80 is pulled out of the drill string 12 by an overshot engaging the fishing shoulder 40*a* and then the overshot is rerun into the drill pipe 12 to latch on to the fishing shoulder 40 of the support connector 34 for removal of the line 24 and steering tool 22. The drill string 12 can now be tripped out conventionally.

Therefore, the present method and apparatus provides an electrical communication between the steering tool 22 and the wireline unit 30 through the inside of the drill string 12 to avoid interference with any blowout preventer. The single piece conductor wire 50 is telescopically and slidably moved through the nonrotating portions of the swivels 56 or 70 through a releasable packoff. The electrical connections can be easily disconnected when the drill pipe 12 is used in a rotary drilling mode or when pipe joints are added to or subtracted from the drill string 12. However, any time that a survey is required, the conductor 50 may be lowered into the electrical communication with the steering tool 22 and can be left connected thereto while surveying the orientation or during slide drilling operations.

The method of the present invention is apparent from the foregoing description of the preferred embodiments. However, the method provides an improvement in the connection of an electrical conductor between the steering tool and the well surface after drilling a well bore to a location where directional drilling is to start. The method includes running and seating a retrievable steering tool into the drill string with a wireline electrical conductor connected to the steering tool, supporting the upper end of the wireline conductor from a retrievable support seated on a shoulder inside the drill string, and inserting a single piece conductor wire into the drill string. The method further includes releasably, telescopically and sealingly connecting the lower end of the single piece conductor to the wireline electrical conductor, and connecting the upper end of the single piece conductor telescopically through the drill string and to the outside of the drill string through a nonrotatable connection to the drill string for raising and lowering the lower end of the single piece conductor in the drill string and for transmitting communication with the steering tool to the well surface.

The method further includes releasably and sealingly engaging the single piece conductor at the nonrotatable connection. The method further includes retracting the lower end of the single piece conductor wire to the top of the drill string, opening the drill string, inserting a wireline segment into the drill string, and releasably, telescopically and sealingly connecting the lower end of the wireline segment to the wireline electrical conductor, and supporting the upper end of the wireline segment in the drill string by a fluid passing support having outwardly and downwardly directed spring fingers seated on the shoulder.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, and steps of the process will be readily apparent to those skilled in the art and which are encompassed within the spirit of the invention and the scope of the appended claims.

What is claimed is:

1. In the method of drilling a directional well with a drill bit in a drill string having a steering tool measuring the orientation of the drill bit, the improvement of connecting an electrical conductor between the steering tool and the well surface comprising, drilling a well bore to a location where directional drilling is to start, running and retrievably setting a steering tool into the drill string with a wireline electrical conductor connected to the steering tool, retrievably supporting an upper end of the wireline conductor from a fluid passing support seated on a shoulder inside the drill string, inserting a single piece conductor wire into the drill string, releasably and telescopically and sealingly connecting a lower end of a single piece conductor to the wireline electrical conductor, connecting an upper end of the single piece conductor telescopically and sealingly through the drill string and to the outside of the drill string through a nonrotatable connection in the drill string for raising and lowering the lower end of the single piece conductor in the drill string and for releasably connecting the single piece conductor to the wireline electrical conductor for transmitting communication with the steering tool to the well surface.

2. The method of claim 1 including, retracting the lower end of the single piece conductor wire to the top of the drill string, opening the drill string, inserting an electrical wireline segment into the drill string and releasably, telescopically and sealingly connecting the lower end of the wireline segment to the wireline electrical conductor, and retrievably supporting the upper end of the wireline segment in the drill string by a fluid passing support having outwardly and downwardly directed spring fingers seated on a shoulder, and releasably, telescopically and sealingly connecting the lower end of the single piece conductor to the upper end of the wireline segments.

3. In the method of drilling a directional well with a drill bit in a drill string having a steering tool measuring the orientation of the drill bit, the improvement of connecting an electrical conductor between the steering tool and the well surface comprising, drilling a well bore to a location where directional drilling is to start, running and retrievably seating a steering tool into the drill string with a wireline electrical conductor connected to the steering tool, retrievably supporting an upper end of the wireline conductor from a fluid passing support seated on a shoulder inside the drill string, inserting a single piece conductor wire telescopically through a sealable packoff in a nonrotatable portion of a swivel connected to the drill string, said single piece conductor wire having a first end and a second end, and having a telescopically electrical connector on the second end inside the swivel adapted to be releasably, telescopically and sealingly connected to the wireline electrical conductor, and the first end positioned outside of the swivel for transmitting communication with the steering tool.

4. The method of claim 3 including, when the distance of the upper end of the wireline conductor from the swivel reaches a predetermined distance, inserting a wireline segment into the drill string and releasably and telescopically and sealingly connecting the lower end of the wireline segment to the wireline electrical conductor, and removably supporting the upper end of the wireline segment in the drill string by a fluid passing support having outwardly and downwardly directed spring biased fingers on a shoulder, and releasably, telescopically and sealingly connecting the lower end of the single piece conductor to the upper end of the wireline segment.

5. In a system for drilling a directional well with a drill bit in a drill string having a steering tool measuring the orientation of the drill bit, the improvement in means for electrically transmitting signals from the steering tool to the well surface comprising, a wireline electrical conductor connected to a retrievable steering tool and extending upwardly in the drill string, a retrievable cable support and connector connected to the upper end of the wireline electrical conductor, said support and connector including a support shoulder for supporting the conductor in the drill string, said connector including a passage therethrough for the passage of fluids through the drill string, said connector including an upstanding electrical contact, said connector including a fishing shoulder for removal of said conductor and said steering tool from the drill string and said connector including sealing means positioned below the electrical contact, a landing sub in the drill string having an inwardly directed seating shoulder for receiving the support shoulder and supporting the removable connector and steering tool, a swivel having a nonrotatable portion connected to the upper end of the drill string, said swivel portion including an opening therethrough and a retractable sealing packoff around the opening, a single piece conductor wire slidably movable through the opening and having first and second ends, said second end being in the drill string and including a releasable telescopically electrical connector adapted to be telescopically and sealingly connected to the upstanding electrical contact and coacting seal means for mating with the connector sealing means, and the first end being positioned outside of the swivel for transmitting communication with the steering tool to the well surface.

6. The apparatus of claim 5 wherein the cable support and connector and single piece conductor include coacting conical sealing surfaces for waterproof sealing.

7. The apparatus of claim 6 including a retrievable wireline segment having upper and lower ends and having a first electrical connector at its lower end adapted to the telescopically and sealingly connected to the upstanding electrical contact and having a second electrical connector at its upper end adapted to be telescopically and sealingly connected to the second end of the single piece conductor wire, said upper end including a cable support and connector having a plurality of downwardly and outwardly directed fluid passing spring fingers for supporting the wireline segment from a shoulder in the drill string.

* * * * *